United States Patent [19]

Metzner

[11] Patent Number: 4,845,950

[45] Date of Patent: Jul. 11, 1989

[54] ROTATION ANGLE DEPENDENT CORRECTION OF SPEED CONTROL SIGNAL IN LOW-SPEED CONSTANT TORQUE CONTROL HYDRAULIC DRIVE

[75] Inventor: Frank Metzner, Hamburg, Fed. Rep. of Germany

[73] Assignee: Mannesmann Rexroth GmbH, Lohr/Main, Fed. Rep. of Germany

[21] Appl. No.: 58,809

[22] Filed: Jun. 5, 1987

[30] Foreign Application Priority Data

Jul. 9, 1986 [DE] Fed. Rep. of Germany ..... 3623066

[51] Int. Cl.[4] ..... F04B 49/06; F04B 1/08

[52] U.S. Cl. ..... 60/448; 60/451

[58] Field of Search ..... 60/445, 449, 451, 452, 60/448, 911; 318/590

[56] References Cited

U.S. PATENT DOCUMENTS 4,487,109 12/1984 Burandt et al. ..... 60/911 X
4,655,689 4/1987 Westveer et al. ..... 60/449 X
4,689,956 9/1987 Hein ..... 60/445 X

*Primary Examiner*—Robert E. Garrett
*Assistant Examiner*—George Kapsalas
*Attorney, Agent, or Firm*—Harness Dickey & Pierce

[57] ABSTRACT

Improved control of a hyrostatic drive machine at very small speeds of rotation. The rotation speed control signal in the creep rotation speed region is modified in dependence upon the actual value of the rotation angle and possibly the efficiency characteristic diagram so as to produce a regulated constant torque.

14 Claims, 1 Drawing Sheet

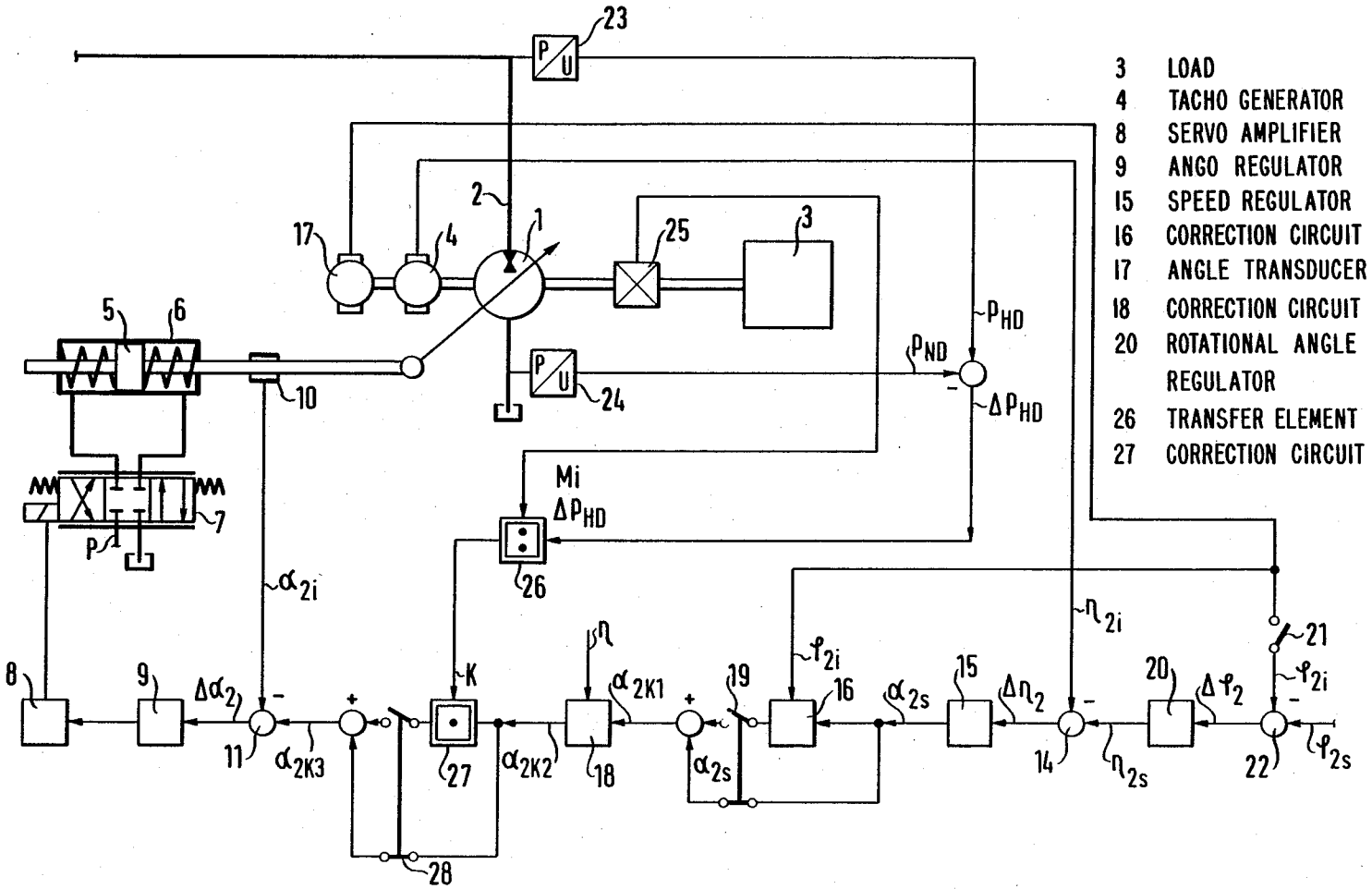
3 LOAD
4 TACHO GENERATOR
8 SERVO AMPLIFIER
9 ANGO REGULATOR
15 SPEED REGULATOR
16 CORRECTION CIRCUIT
17 ANGLE TRANSDUCER
18 CORRECTION CIRCUIT
20 ROTATIONAL ANGLE REGULATOR
26 TRANSFER ELEMENT
27 CORRECTION CIRCUIT

ROTATION ANGLE DEPENDENT CORRECTION OF SPEED CONTROL SIGNAL IN LOW-SPEED CONSTANT TORQUE CONTROL HYDRAULIC DRIVE

BACKGROUND OF THE INVENTION

The invention relates to a circuit arrangement for rotation speed regulation of a hydrostatic machine connected to a conduit with impressed pressure.

In the known electrical speed regulation of such a machine (German Patentschrift No. 3441185, Aug. 13, 1987) the rotation speed desired value and the rotation speed actual value generated in a tachogenerator or other pickup are supplied to the rotation speed regulator. Connected to the speed regulator is a pivot angle adjustment means for the machine. The pivot angle of the machine working as motor for driving a load defines the absorption (displacement) volume. This generates a torque for driving the load, a corresponding speed of rotation resulting.

With very small adsorption (displacement) volumes of the machine corresponding to relatively small rotation speeds of regulation behavior of the machine is greatly impaired because in the region of very small speeds there is no proportionality between the pivot angle of the machine and the torque generated by the machine. There are several reasons for this: with reciprocating piston machines during a revolution the number of acting operating pistons changes, this also changing the torque generated. Furthermore, the frictional torque arising at the machine and the leakage losses depend on the rotation angle so that this also reduces the uniformity of the torque.

The consequence is that at small rotation speeds the drive turns jerkily and irregularly and can even stop altogether under load. Under such operating conditions the control operation carried out by the speed regulator takes place too late and as a result due to the phase displacement between rotation speed deviation and correction no uniform speed can be set.

The problem underlying the invention resides in improving the circuit arrangement for the rotation speed regulation of the type outlined at the beginning so that even very small speeds can be reliably controlled.

SUMMARY OF THE INVENTION

According to the invention the speed control signal present as output of the speed regulator and representing the pivot angle desired value for the absorption setting of the machine is varied in dependence upon the rotation angle actual value of the hydrostatic machine in the range of small speeds in such a manner that the torque delivered by the machine remains constant. Thus, the pivot angle desired value is corrected in dependence upon the rotation angle signal. The circuit arrangement according to the invention offers particular advantages when the machine operates as positioning drive, i.e. for example a tool or the like is to be moved by very low rotation speed into an exact position after disconnection of a fast feed. Usually, after switching off the fast feed the rotation speed of the drive diminishes corresponding to a function, for example a ramp, until the end point is reached. It is particularly advantgeous when the positioning can take place down to very small creep speeds of rotation.

A further development of the invention resides in that the rotation speed control signal is corrected in dependence upon the characteristic diagram of the hydraulic-mechanical and volumetric efficiency of the hydrostatic machine in such a manner that the torque generated by the machine remains constant. The efficiency is thus determined in the range of the low rotation speeds and corresponding correction factors generated so that in dependence upon the rotation speed the stored correction factors can be called up and linked to the speed control signal.

BRIEF DESCRIPTION OF THE DRAWINGS

An example of embodiment of the invention will be explained in detail hereinafter with the aid of the drawings in which a circuit arrangement for rotation speed control of a hydrostatic machine is schematically illustrated.

DETAILED DESCRIPTION OF THE PREFERRED EMBODIMENT

A hydrostatic machine 1 with variable volume and pivotal beyond the zero point into both adjustment ranges for pump and motor operation is connected to a pressure conduit 2 with impressed pressure and coupled to a load 3 and a tachogenerator 4 which supplies an actual value signal of the rotation speed. The pivot angle of the machine 1 is set by the piston 5 of the actuating cylinder 6. For this purpose the piston 5 is subjected via a servovalve 7 to fluid. The servovalve 7 is actuated via a servo amplifier 8 which is connected to a pivot angle regulator 9 to which the difference between the pivot angle actual value $\alpha_{2i}$ and the pivot angle desired value $\alpha_{2k3}$ is supplied. The difference is formed in a comparison stage 11. The pivot angle actual value is generated in a displacement pickup 10. The value $\alpha_{2k3}$ is equal to $\alpha_{2k2}$, when the comparison stage is connected via the switch 28 directly to the correction circuit 18.

In comparison stage 14 the speed difference is formed from the speed actual value $n_{2i}$ and the speed desired value $n_{2s}$ and is supplied to the speed regulator 15. The rotation speed control output signal $\alpha_{2s}$ represents the pivot angle desired value for setting the absorption capacity of the machine 1 which at a predetermined load generates a predetermined rotation speed.

The rotation speed control signal is corrected in a transfer element 16 in dependence upon the rotation angle actual value $\rho_{2i}$. The rotation angle actual value of the machine is generated in a pulse generator 17 which is coupled to the machine 1.

In dependence upon the digital rotation angle signal increment generated in the pulse generator 17 the nonlinear transfer or transmission element 16 changes the pivot angle desired value in accordance with the following equation:

$$\alpha_{2k1} = \alpha_{2s}\left(1 \pm \frac{1}{2n}\right) = \alpha_{2s} \pm \frac{\alpha_{2s}}{2n}$$

The rhythm of the rotation angle signal is governed by $$\rho_{2R} = \frac{360°}{2n}$$

wherein n is the (total number of) pistons in the machine.

Proceeding from a value zero at the start of the first regulating operation for the rotation angle step width $\rho_{2R}$ in accordance with the above equation a counter z is incremented, it being assumed that the machine 1 and the pulse generator 17 are synchronized. To avoid exceeding the counting range z is reset when a predetermined limit is exceeded.

For odd z ((Z/2)≠integer (Z/2)) the pivot angle correction which applies is then $$\alpha_{2k1} = \alpha_{2s} - \frac{\alpha_{2s}}{2n}$$

For even z ((Z/2)=integer (Z/2)) even the following equation applies $$\alpha_{2k1} = \alpha_{2s} + \frac{\alpha_{2s}}{2n}$$

In a further non-linear transmission or transfer element 18 the corrected pivot angle desired value $\alpha_{2k1}$ is corrected in dependence upon the efficiency so that at the output the twice-corrected pivot angle desired value $\alpha_{2k2}$ is present. This makes it possible to improve the result of the first correction from the transfer element 16. The correction is carried out in accordance with $$\alpha_{2k2}=\alpha_{2k1}\cdot\eta(\Delta p_{HD}, n_2, \alpha_2)^{-1}$$

In dependence upon the efficiency for the measured characteristics of the high pressure difference $\Delta P_{HD}$ in the conduit 2 with impressed pressure, the speed $n_2$ and the pivot angle $\alpha_2$, a factor is determined which depends on the efficiency and by which the pivot angle desired value $\alpha_{2k1}$ is multiplied.

The values for the efficiency characteristic diagram with the associated multiplication factors are preferably contained in a memory.

Preferably, above a predetermined limit rotation speed the two correction circuits 16 and 18 are disabled. For this purpose for example a switch 19 is provided which opens in this case so that the transfer element 16 is bridged and to pivot angle desired value $\alpha_{2s}$ of the rotation speed regulator 15 is applied directly to the transfer element 18 whose multiplication factor in this case is set to one.

In the example of embodiment the speed regulator 15 is also preceded by a rotation angle regulator 20 to which the difference $\Delta\rho_2$ of the rotation angle actual value $\rho_{2i}$ and a rotation angle desired value $\rho_{2s}$ is supplied and which provides the speed desired value signal $n_{2s}$. Via a switch 21 the rotation angle actual value $\rho_{2i}$ is supplied only beneath the aforementioned limit rotation speed. The rotation angle regulator 20 is thus effective only at creep speed, in particular to permit a rotational position drive; it may however also remain activated above the creep speeds. The speed desired value signal $n_{2s}$ furnished by the rotation angle regulator 20 can have a ramp-like form, in particular decrease in ramp manner from a predetermined high speed to a creep speed and can in particular reach the speed zero after a predetermined number of increment steps of the rotation angle $\rho_2$ to stop the drive in a predetermined position.

Above the limit rotation speed the switch 21 is preferably open so that the speed desired value $n_{2s}$ corresponds to the rotation angle desired value $\rho_{2s}$.

The rotation angle controller or regulator 20, the speed regulator 15 and the pivot angle regulator 9 are provided with limiting circuits which ensure that the respective output signals of the regulators cannot exceed a predetermined amplitude.

Furthermore, the pulse generator 17 and the tachogenerator 4 may be combined in a unit.

In particular in drives having a low total inertia of hydromotor 1 and load 3 the relatively poor control behaviour of the control circuit (slow response, large rotation speed changes, slow correction) regulating from the low amplification of the rotation speed control circuit can be improved in that a correction value $\alpha_{2k3}$ is formed proportional to the quotient of the measured actual value of the torque $M_i$ and the measured actual value of the high-pressure difference $\Delta p_{HD}$:

$$\alpha_{2K3} = K \cdot \frac{M_i}{\Delta p_{HD}} \cdot \alpha_{2max}\ [\%]$$

This advantageously prevents a temporary speed difference due to the action of the load at the moment of its rising by adapting the torque $M_2$ of the hydro unit 1 to the load 3.

Thus, by controlling the rotation speed desired value $n_{2s}$ it is ensured that said correction algorithm on a time variation thereof has no effect.

It should be ensured with a suitable circuit that this correction algorithm is of no effect stationarily.

It is apparent from the drawing that for this high-pressure-dependent load correction the torque $M_i$ of the motor 1 is determined in a torque measuring means 25 and the pressure gradient of the motor from high pressure $p_{HD}$ to low pressure $p_{ND}$ determined in each case in a pressure sensor 23, 24. The values $\Delta p_{HD}$ and $M_i$ are combined in a transfer element 26 in accordance with the aforementioned equation and a factor K is generated which is supplied to a further correction circuit 27 which when the switch 28 is actuated furnishes a corrected pivot angle $\alpha_{2K3}$ dependent on the high pressure and torque.

The time behaviour of the total speed regulator circuit corresponds to a delay member of at least the 3rd order. The time constants can be determined from simulation data and results or from an on-line parameter identification. By breaking down into partial fractions the real roots of the three delay members of the 1st order or the mixed real-conjugate complex roots of the delay member of the 2nd order and the real roots of the delay member of the 1st order are determined.

By a suitable compensation circuit of two time members in the rotation speed regulator the two dominant time constants of the nominator broken down into partial fractions of the transfer element are approximately eliminated and thus the oscillatable overall system of the 3rd order converted to a non-oscillatable system of approximately the 1st order. With such a pole compensation a time constant compensation for the speed regultor is achieved.

I claim:

1. Circuit arrangement for controlling the rotation speed regulation of a hydrostatic machine operated from a conduit with an impressed pressure, a pickup coupled to said machine for generating a rotational speed actual signal indicative of actual machine speed, a rotation speed regulator for receiving the rotation speed actual value from said pickup and for generating a control signal from an arbitrarily settable desired value for rotation speed, a valve operated by said control signal for actuating an actuator for adjusting said machine to set the rotation speed of said machine, characterized in that means provide a rotational angle signal from said machine and means correct said rotation speed control signal in relation to the rotation angle signal of the machine to maintain constant torque delivery from said machine.

2. Circuit arrangement according to claim 1 characterized in that the means for providing the rotation angle signal comprises a pulse generator coupled to the machine.

3. Circuit arrangement according to claim 1, characterized in that the output of the rotation speed regulator is connected to a transfer element to which the rotation angle actual signal is supplied and by which with varying rotation angle the rotation speed control signal is corrected in accordance with the following relationship:

$$\alpha 2k_1 = \alpha 2s \pm \frac{\alpha 2s}{2n},$$

wherein $\alpha_{2s}$ is the rotation speed control signal, $\alpha 2k_1$ is the corrected rotation speed control signal and n is the number of positions of the machine.

4. Circuit arrangement according to claim 3 characterized in that the transfer element is activatable in response to the rotation speed of the machine.

5. Circuit arrangement according to claim 3 characterized in that the transfer element has limiting means for limiting the amplitude of the output signal when a predetermined value is exceeded.

6. Circuit arrangement according to claim 1 characterized in that efficiency correction means further correct the corrected rotation speed control signal in dependence upon the efficiency of the machine.

7. Circuit arrangement according to claim 6 characterized in that the efficiency correction means comprises a transfer element in which a characteristic field for the efficiency of the machine at low speeds of rotation is stored and by which the corrected rotation speed control signal is multiplied by an efficiency-dependent factor.

8. Circuit arrangement according to claim 7 characterized in that the multiplication factor of the transfer element is set to one under predetermined speed conditions.

9. Circuit arrangement according to claim 1 characterized in that a poition control circuit is provided to which the corrected rotation speed control signal and the pivot angle actual signal are supplied.

10. Circuit arrangement according to claim 1 characterized in that means are provided for deactivating the rotation angle actual signal dependent upon a selected rotation speed being reached.

11. Circuit arrangement according to claim 1 characterized in that the rotation speed desired value is generated in a rotation angle control circuit to which the rotation angle actual signal from the machine and a rotation angle desired signal are supplied.

12. Circuit arrangement according to claim 11, characterized in that a rotation angle regulator changes the rotation speed desired signal in accordance with a predetermined function.

13. Circuit arrangement according to claim 12 in which the machine is provided as positioning drive, characterized in that the rotation angle regulator is provided for controlling the positioning.

14. Circuit arrangement according to claim 13 characterized in that pole compensation is provided for the regulator.

* * * * *

UNITED STATES PATENT AND TRADEMARK OFFICE

CERTIFICATE OF CORRECTION

PATENT NO. :4,845,950

DATED :July 11, 1989

INVENTOR(S) :Frank Metzner

It is certified that error appears in the above-identified patent and that said Letters Patent is hereby corrected as shown below:

Title Page:

Abstract, line 1, "hyrostatic" should be --hydrostatic--.

Column 1, line 22, "adsorption" should be --absorption--.

Column 1, line 24 (first occurrence), "of" should be --the--.

Column 1, line 60, "by" should be --with--.

Column 3, line 55, "speed" should be --speeds--.

Column 4, line 9, "regulating" should be --resulting--.

Column 5, line 29, Claim 3, "positions" should be --pistons--.

Column 6, line 15, Claim 9, "poition" should be --position--.

Signed and Sealed this

Seventeenth Day of March, 1992

*Attest:*

HARRY F. MANBECK, JR.

*Attesting Officer*

*Commissioner of Patents and Trademarks*